US006350152B1

(12) United States Patent
Belopolsky et al.

(10) Patent No.: US 6,350,152 B1
(45) Date of Patent: Feb. 26, 2002

(54) STACKED ELECTRICAL CONNECTOR FOR USE WITH A FILTER INSERT

(75) Inventors: Yakov Belopolsky, Harrisburg; Robert E. MacMullin, Wellsville, both of PA (US)

(73) Assignee: Berg Technology Inc., Harrisburg, PA (US)

( * ) Notice: Subject to any disclaimer, the term of this patent is extended or adjusted under 35 U.S.C. 154(b) by 0 days.

(21) Appl. No.: 09/644,485

(22) Filed: Aug. 23, 2000

(51) Int. Cl.[7] ..... H01R 13/60
(52) U.S. Cl. ..... 439/541.5; 439/620
(58) Field of Search ..... 439/541.5, 79, 439/620, 670

(56) References Cited

U.S. PATENT DOCUMENTS

| | | | | |
|---|---|---|---|---|
| 5,037,330 A | | 8/1991 | Fulponi et al. | 439/607 |
| 5,167,531 A | | 12/1992 | Broschard, III et al. | 439/540 |
| 5,456,619 A | | 10/1995 | Belopolsky et al. | 439/620 |
| 5,613,880 A | * | 3/1997 | Wang | 439/620 |
| 5,637,015 A | | 6/1997 | Tan et al. | 439/607 |
| 5,730,621 A | * | 3/1998 | Wang | 439/541.1 |
| 5,735,042 A | * | 4/1998 | Takano et al. | 29/874 |
| 5,759,067 A | * | 6/1998 | Scheer | 439/607 |
| 5,797,770 A | | 8/1998 | Davis et al. | 439/607 |
| 6,159,050 A | * | 12/2000 | Belopolsky | 439/620 |
| 6,171,151 B1 | * | 1/2001 | Lu et al. | 439/620 |
| 6,171,152 B1 | * | 1/2001 | Kunz | 439/620 |

FOREIGN PATENT DOCUMENTS

EP 0849842 A2 6/1998

* cited by examiner

*Primary Examiner*—Gary Paumen
*Assistant Examiner*—Phuongchi T Nguyen
(74) *Attorney, Agent, or Firm*—Perman & Green, LLP

(57) ABSTRACT

A stacked connector comprises a first receptacle in a first portion of the connector. A second receptacle is stacked on the first receptacle in the first portion of the connector. A group of first contacts is arranged in the first receptacle. A group of second contacts is arranged in the second receptacle. A second portion of the connector is arranged adjacent to the first and second receptacles and includes a recess extending across the first and second receptacles for receiving an insert containing at least one filtering circuit element. The groups of first and second contacts have extensions extending into the second portion of the connector, the extensions of the first and second contacts are arranged along one wall of the recess for connection to the insert. A group of third contacts is provided separate from the groups of first and second contacts. The group of third contacts is arranged along a different wall of the recess for connection to the insert and for connecting the stacked connector to circuitry external of the stacked connector and the insert.

30 Claims, 11 Drawing Sheets

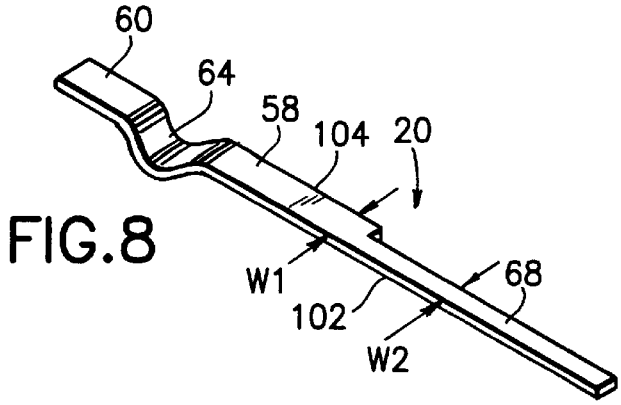
FIG.8
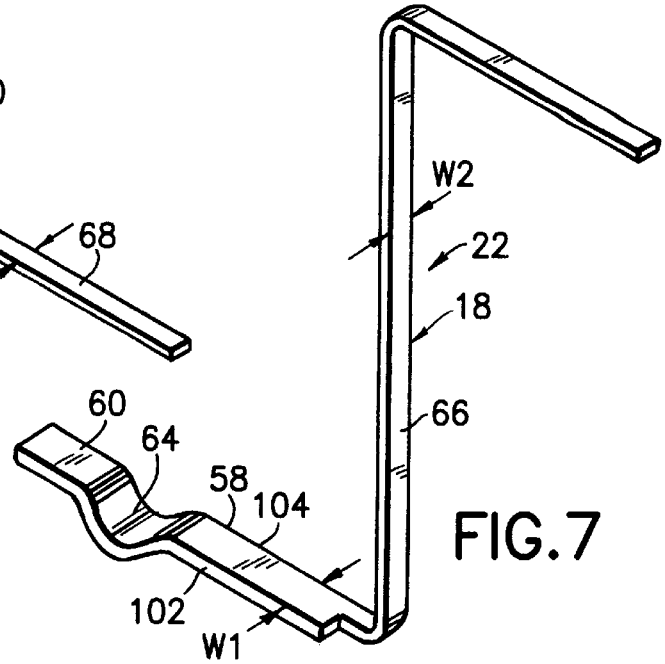
FIG.7
FIG.10
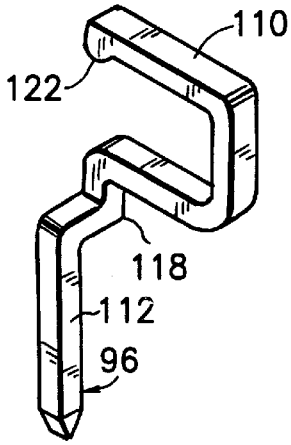
FIG.11
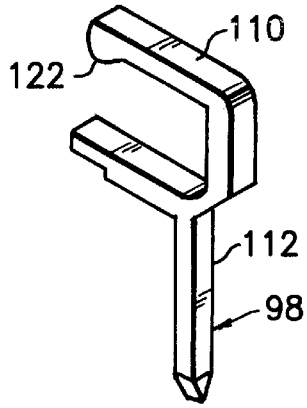

STACKED ELECTRICAL CONNECTOR FOR USE WITH A FILTER INSERT

FIELD OF THE INVENTION

The present invention relates to stacked electrical connectors and more particularly, to stacked electrical connectors in which a noise filter may be incorporated.

BACKGROUND OF THE INVENTION

In electronic devices containing stacked connectors, various types of filters are used to reduce or eliminate noise. Such filters may include a three terminal capacitor or a common mode choke coil. A disadvantage in the use of such filters is that they may complicate the production of the circuit board. A need, therefore, has been perceived for providing a simple means of filtering noise in stacked connectors.

The use of an integral ferrite element for this purpose is proposed in Japanese Patent Publication 64-2273. This reference discloses a modular jack having a modular insert installed in a casing. The body of the insert is formed with ferrite, and on one side of the insert body insert holes are formed for introducing connecting lines to be connected to respective contact springs. While this reference would appear to simplify the apparatus used for noise filtering in modular jacks, a need for further increasing the compactness of such modular jacks with integral filtering elements existed.

U.S. Pat. No. 5,456,619 discloses a filtered modular jack assembly having an outer insulative housing with open front and rear sides. A ferrite filtering element is positioned adjacent the rear end, and an elongated insulative insert is superimposed over the ferrite element. The insulative insert is fixed to the housing.

U.S. application Ser. No. 09/338,354 (Attorney's Docket No. BERG-2477/C2364 US) is directed to a modular jack assembly which includes an outer insulative housing. This assembly also includes an insulative insert and an electronic filtering component mounted in a recess in the rear section of the insulative insert, which is adapted to be easily and compactly mounted in the jack.

Connector receptacles which are adapted to be mounted on a PWB are well known in the art. The universal serial bus (USB) connector, for example, is used in many computer and computer peripheral applications to provide for easy connection of the peripherals to computer devices. The USB connection is expected to become increasingly popular as it provides for numerous connections to the computer device without exhausting limited computer device resources. In addition, the USB connector is an excellent solution for attaching peripheral devices to portable computing devices such as notebooks. Accordingly, many computers now include two or more USB receptacles.

In the conventional USB connector there is essentially an insulative member which houses a plurality of contacts which extend horizontally then vertically to engage the PWB. A conductive shield has an upper wall which is superimposed over the horizontal section of the insulated insert. The conductive shield also has a lower wall adjacent the PWB, and the upper and lower walls are connected with the vertical side walls to form a plug receiving cavity.

U.S. provisional application Ser. No. 60/147,830 (Attorney's Docket No. BERG-2529/C2409 US) is directed to an electrical connector system having a housing including a plurality of receiving spaces each adapted to receive a complementary electrical connector. The electrical connector system includes a plurality of contacts arranged in groups corresponding to a respective one of the receiving spaces and a common filter element connected to contacts in each of the groups. The connector also includes an outer shield that generally surrounds the housing and grounding contacts to create an electrical connection between the conductive outer shield and the plug element when inserted therein. In accordance with a feature of this application, the electrical connector system may be configured as a double deck receptacle.

U.S. Pat. Nos.: 5,037,330, 5,167,531, 5,637,015 and 5,797,770 are illustrative of prior patents relating to stacked or double decked connectors.

The patents and patent applications set forth above are specifically intended to be incorporated by reference herein.

Commercially available modular connector systems with integrated magnetic filtering components are sold under the NETJACK® trademark by FCI Framatone Group. These connectors include magnetic components and enhanced electrical shielding which are important for EMI suppression. The magnetic components can include common mode chokes, isolation transformers, and other known filtering circuit elements.

While modular connector systems with integrated filter circuits are known there is a need for stacked connectors wherein the connectors are one on top of the other and have an expanded filter circuit insert capable of housing an appropriate number of filtering circuit elements. Due to the stacked nature of such connectors it is difficult to use a large insert which can include enough filtering circuit elements therein.

SUMMARY OF THE INVENTION

The present invention is directed to a stacked connector comprising a first receptacle in a first portion of the connector and a second receptacle stacked on the first receptacle in the first portion of the connector. A group of first contacts is arranged in the first receptacle and a group of second contacts is arranged in the second receptacle. A second portion of the connector is arranged adjacent to the first and second receptacles and includes a recess extending behind the first and second receptacles for receiving an insert containing at least one filtering circuit element. The groups of first and second contacts have extensions which extend into the second portion of the connector. The extensions of the first and second contacts are arranged along one wall of the recess for connection to the insert. A group of third contacts is arranged separately from the groups of first and second contacts along a different wall of the recess for connection to the insert and for connecting the stacked connector to circuitry external of the stacked connector and the insert.

In a preferred embodiment the first portion of the connector comprises a front portion of the connector and the second portion of the connector comprises a rear portion of the connector behind the front portion. The connector includes a top portion and a bottom portion, with the first receptacle being located in the bottom portion and the second receptacle being located in the top portion. The extensions of the first and second contacts are arranged in the top portion of the connector and the third contacts are arranged in the bottom portion of the connector. Most preferably the extensions of the first and second contacts are arranged in a row along the wall with the extensions of the first contacts alternating in the row with the extensions of the second contacts.

In a preferred embodiment the second contacts are arranged in the second receptacle above the first contacts in the first receptacle and corresponding first and second contacts of the receptacles are aligned in a given plane. Preferably the first and second contacts have a given width in the receptacles and a narrower width in the extensions of the contacts. The extensions of the first contacts are arranged toward one side of the first or second contacts and the extensions of the second contacts are arranged toward an opposing side of the first or second contacts. This permits the extensions of the first and second contacts to extend substantially parallel to one another to the wall of the recess without interference.

In a further preferred embodiment a first portion of the group of third contacts is arrange in a single row in the recess along the different wall, and a second portion of the third group of contacts is arranged in at least two substantially parallel rows for connection externally of the connector, the first portion of the third group of contacts being adapted for connection to the insert and the second portion of the third group of contacts being adapted for connection to external circuitry The contacts for external connection are arranged in a first row corresponding to the contacts in the first receptacle and a second row corresponding to the contacts in the second receptacle. Each of the contacts for external connection in the first row is preferably arranged in a common plane with a corresponding contact for external connection in the second row. The third contacts for external connection in one of the first or second rows of contacts for external connection may include a bend portion intermediate the first and second portions of the third contacts, which permits the contacts in the one of the rows to transition from a single row of third contacts at the first portion thereof to the substantially parallel rows of the third contacts at the second portion thereof. Preferably corresponding contacts in one row of the third contacts are arranged in a common plane with the corresponding contacts in the other row of third contacts.

In the most preferred embodiment a filter insert is provided in the recess, which is electrically connected between the extensions of the first and second contacts in the recess and the first portions of the third contacts in the recess, which are to be utilized in circuitry connected by the connector.

It is the aim of this invention to have an improved stacked connector for use with a filtering circuit insert.

It is a further aim of this invention to provide such a connector with an enlarged recess which permits a large filtering circuit insert to be utilized.

These and other aims will become apparent from the following description and drawings.

The foregoing summary, as well as the following detailed description of the preferred embodiments, is better understood when read in conjunction with the appended drawings. For the purpose of illustrating the invention, there is shown in the drawings an embodiment that is presently preferred, in which like references numerals represent similar parts throughout the several views of the drawings.

BRIEF DESCRIPTION OF THE DRAWINGS

The stacked connector assembly of the present invention is further described with reference to the accompanying drawings in which:

FIG. 7 is a perspective view of a contact and its extension for use in the bottom receptacle of the stacked connector of FIG. 1;

FIG. 8 is a perspective view of a contact and its extension for use in the top receptacle of the stacked connector of FIG. 1;

FIG. 10 is a perspective view of a contact for use in the forward row of contacts shown in FIG. 9;

FIG. 11 is a perspective view of a contact for use in the rearward row of contacts shown in FIG. 9;

DETAILED DESCRIPTION OF THE PREFERRED EMBODIMENTS

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
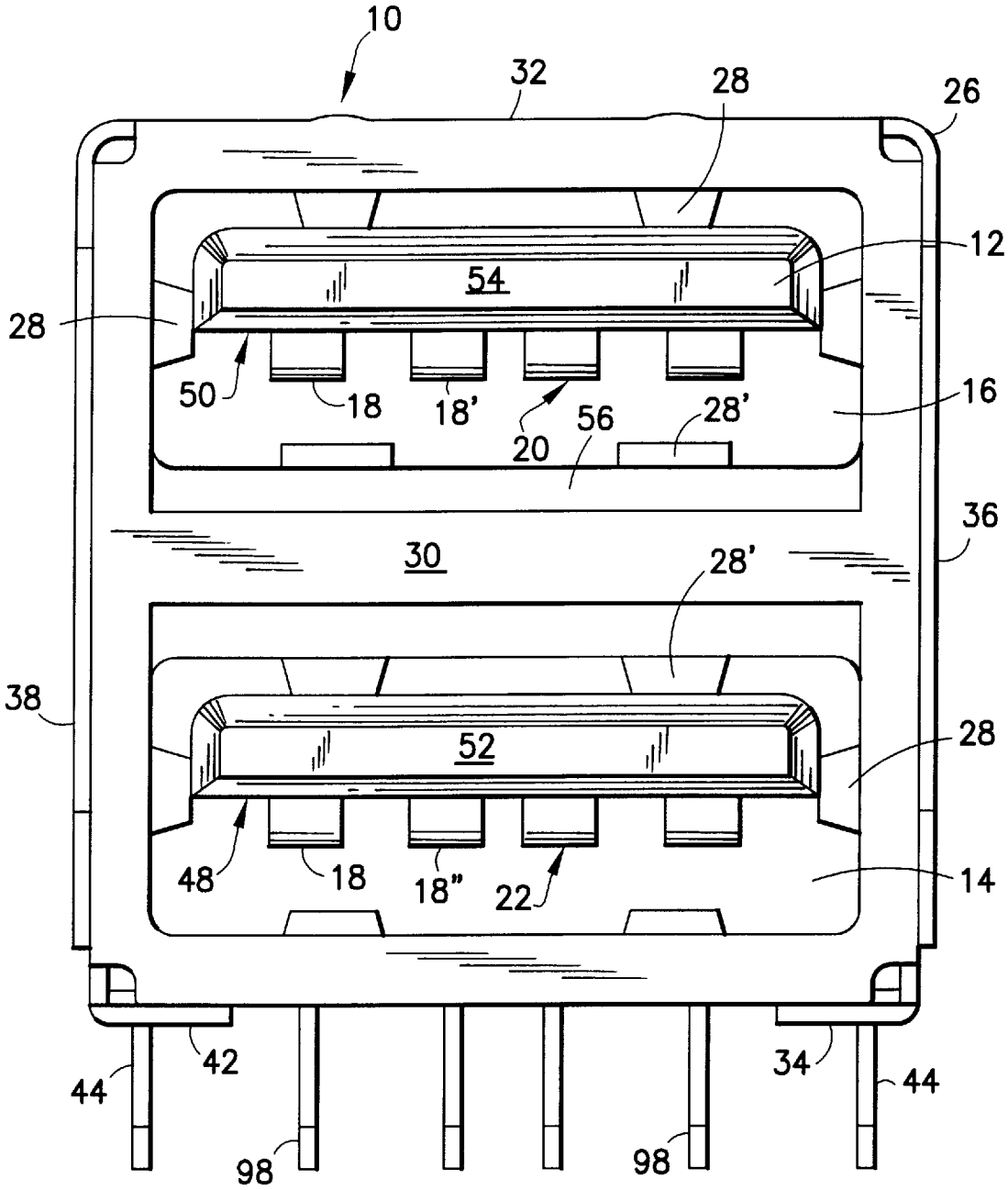
FIG. 1 is a front schematic view of a stacked connector representing a preferred embodiment of the present invention.
Figure 2:
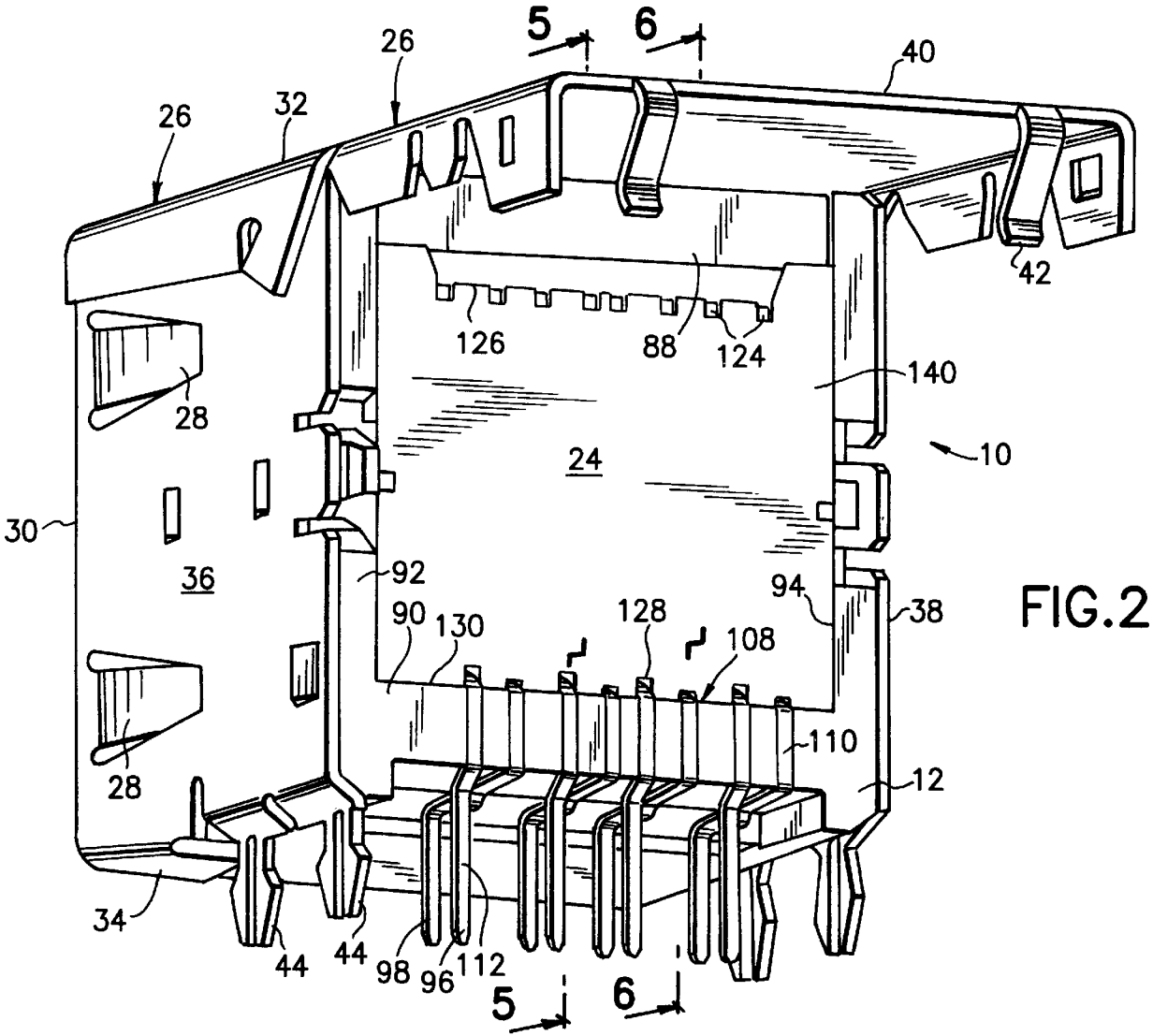
FIG. 2 is a perspective view of the stacked connector shown in FIG. 1 viewed from the rear, with the rear shield or cover bent upward.

Referring to FIGS. 1 and 2 the present invention is directed to an electrical connector system 10 having a housing 12 including a plurality of receiving spaces or receptacles 14 and 16 each adapted to receive a complementary electrical connector (not shown). The electrical connector system includes a plurality of contacts 18 arranged in first and second groups 20 and 22 corresponding to a respective one of the receptacles 14 or 16 and a common filter element or insert 24 connected to contacts 18 in each of the groups 20 and 22. The connector 10 also includes an outer shield 26 that generally surrounds the housing 12 and has grounding contacts 28 to create an electrical connection between the conductive outer shield 26 and the plug element (not shown) when inserted therein.

While the drawings display a double deck USB connector system 10, the present invention could be used with any type of electrical connector. While each receptacle is shown with four contacts 18 in a group 20 or 22 the invention can be employed with any desired number of contacts 18 in a group. Similarly, while two receptacles 14 and 16 are shown, the invention can be employed with any desired number of stacked receptacles.

Double deck receptacle 10 includes a conductive shield 26. Preferably stamped from a single sheet of suitable conductive material, shield 26 includes a front wall 30, a top wall 32, bottom wall 34, opposed lateral walls 36 and 38, and a rear wall 40. The front wall 30 defines a plurality of receiving spaces 14 and 16 each of which can receive a plug (not shown). The opposed lateral walls 36 and 38 each have longitudinal springs 28 bent so as to extend into the receptacle 14 or 16 opening to bear against a corresponding shield (not shown) on the plug (not shown). The bottom wall 34 also includes longitudinal springs 28 that bear against the plug shield for the same purpose. The conductive shield 26 is equipped with tabs 42 that are used to secure the shield 26 on the housing 12. Tabs 42 also act as stand-offs to position the connector 10 relative to a PWB (not shown). Hold downs 44 aid in mounting and positioning the connector 10 with respect to the PWB. Please note that in FIGS. 5 and 6 the rear hold downs are omitted for clarity.

Figure 5:
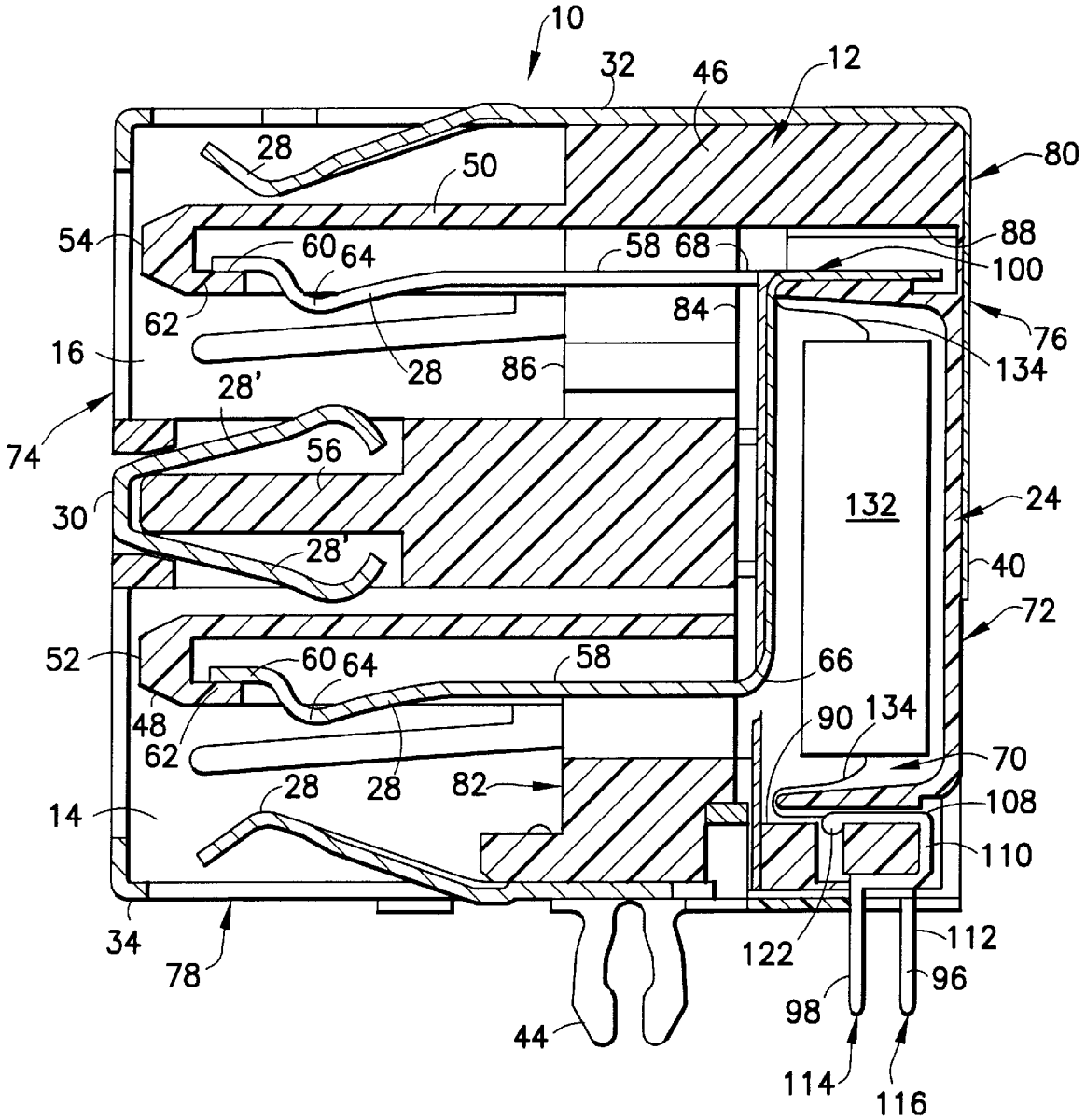
FIG. 5 is a partial cross sectional view through 5—5 in FIG. 2.

As illustrated in FIGS. 1 and 5, grounding contacts 28' extend into the receiving spaces 14 and 16 from the front wall 30 of the shield 26 to provide a further electrical connection between the conductive shield 26 of the connector 10 and the shielding of a plug when inserted therein. The grounding contacts 28 and 28' are formed from the conductive shield 26 and are provided to reduce electromagnetic interference.

As shown in FIGS. 1 through 6, the insulative housing 12 has a rear 30 section 46 with flanges 48 and 50 that extend forwardly therefrom. The upper 50 and lower 48 flanges include front edges 52 and 54. The upper and lower flanges 52 and 54 carry contacts 18. Contacts 18 may be signal contacts, a power signal, or a ground contact in various combinations as desired in accordance with a particular application. Also as illustrated, a middle flange 56 extends from the insulative member 12 to separate receptacle openings 14, 16.

Referring particularly to FIGS. 5 to 8 the contacts 18 each include a first section 58 extending in a direction generally parallel to the flanges 48 or 50 and have a forward terminal end 60 that is engaged by the front contact retaining lip 62 of the respective flange 48 or 60. This first section 58 also includes a convex bend 64 which extends beneath the lip 62. The contacts 18 also include an extended section 66 or 68 which extends into a portion of the housing 12 defining a recess 70 for receiving a filter circuit insert module 72. The contacts 18 may be supported in the housing 12 by any desired conventional means. For example, the housing 12 can be molded about the contacts 18 at a point along the first section 58 or the extended section 66 or 68 or they may be held in slots in the housing as described in the patents and applications set forth in the Background, which have incorporated by reference herein.

Referring again to FIGS. 1–6, the housing 12 is preferably constructed of a thermoplastic polymer having suitable insulative properties and the exterior shielding is preferably metallic. Within the walls 30 to 40 is a first portion 78 or forward open end having the receptacles 14 and 16 and a second portion 80 or rear open end defining a recess 70 for receiving the filtering circuit element or module 72. Projecting upwardly from the bottom wall 34 in this interior section there is a medial wall generally shown at numeral 82 which separates the first portion 78 of the connector 10 from the second portion 80. The medial wall 82 has a rear side 84 and a front side shown generally at numeral 86. The contacts 18 are supported as described above within the medial wall 82. The top wall 88, bottom wall 90 and opposing lateral walls 92 and 94 of recess 70 extend rearwardly from the rear side 84 of the medial wall to form a generally rectilinear opening for receiving the insert 24. The opening defined by the recess 70 may have any desired shape and it is shown as rectilinear solely by way of example. It could have curved walls. It could be circular or some other curvilinear shape. It could be non-symmetrical so that the corresponding insert 24 can be placed in the recess 70 in only one orientation. Extending downwardly from the bottom wall 90 of the recess 70 there are terminals 96 and 98.

Referring now to FIGS. 1 through 11 the structure and arrangement of the contacts 18 and terminals 96 and 98 will be discussed in greater detail. The present invention is directed to a stacked connector 10 comprising a first receptacle 14 in a first portion 74 of the connector 10 and a second receptacle 16 stacked on the first receptacle 14 in the first portion of the connector 10. A group of first contacts 18 is arranged in the first receptacle 14 and a group 22 of second contacts 18 is arranged in the second receptacle 16. A second portion 76 of the connector 10 is arranged adjacent to the first 14 and second 16 receptacles and includes the recess 70, which extends behind the first 14 and second 16 receptacles for receiving an insert 24 containing at least one filtering circuit element which will be described in greater detail later. The groups 20 and 22 of first and second contacts 18 have extensions 66 and 68, which extend into the second portion 78 of the connector 10. The extensions 66 and 68 of the first and second groups 20 and 22 of contacts 18 are arranged along the top wall 88 of the recess 70, preferably in single file fashion, for connection to the insert 70.

Figure 3:
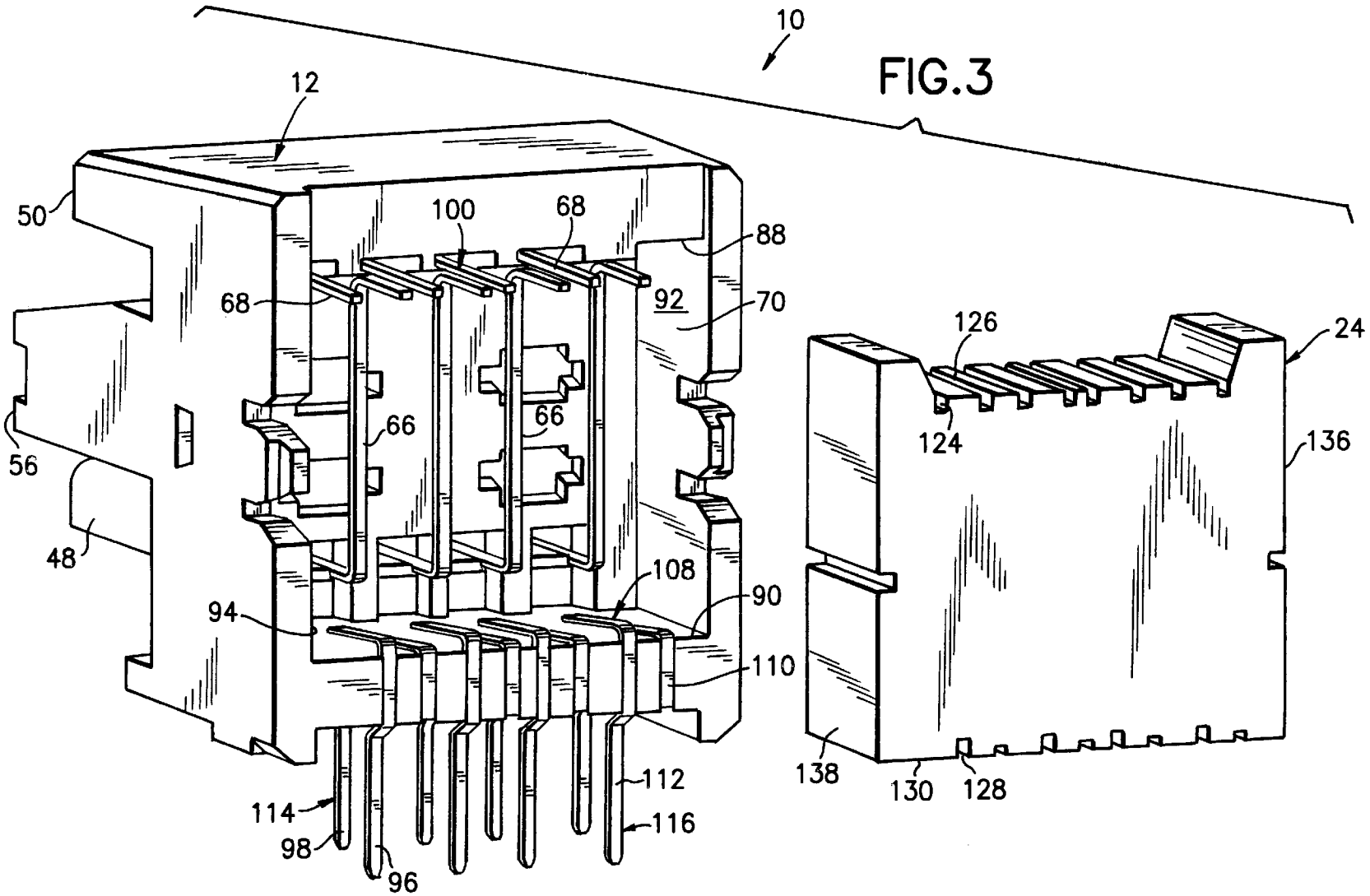
FIG. 3 is an exploded perspective view of the stacked connector of FIG. 1 viewed from the rear, with the shield or cover removed.
Figure 6:
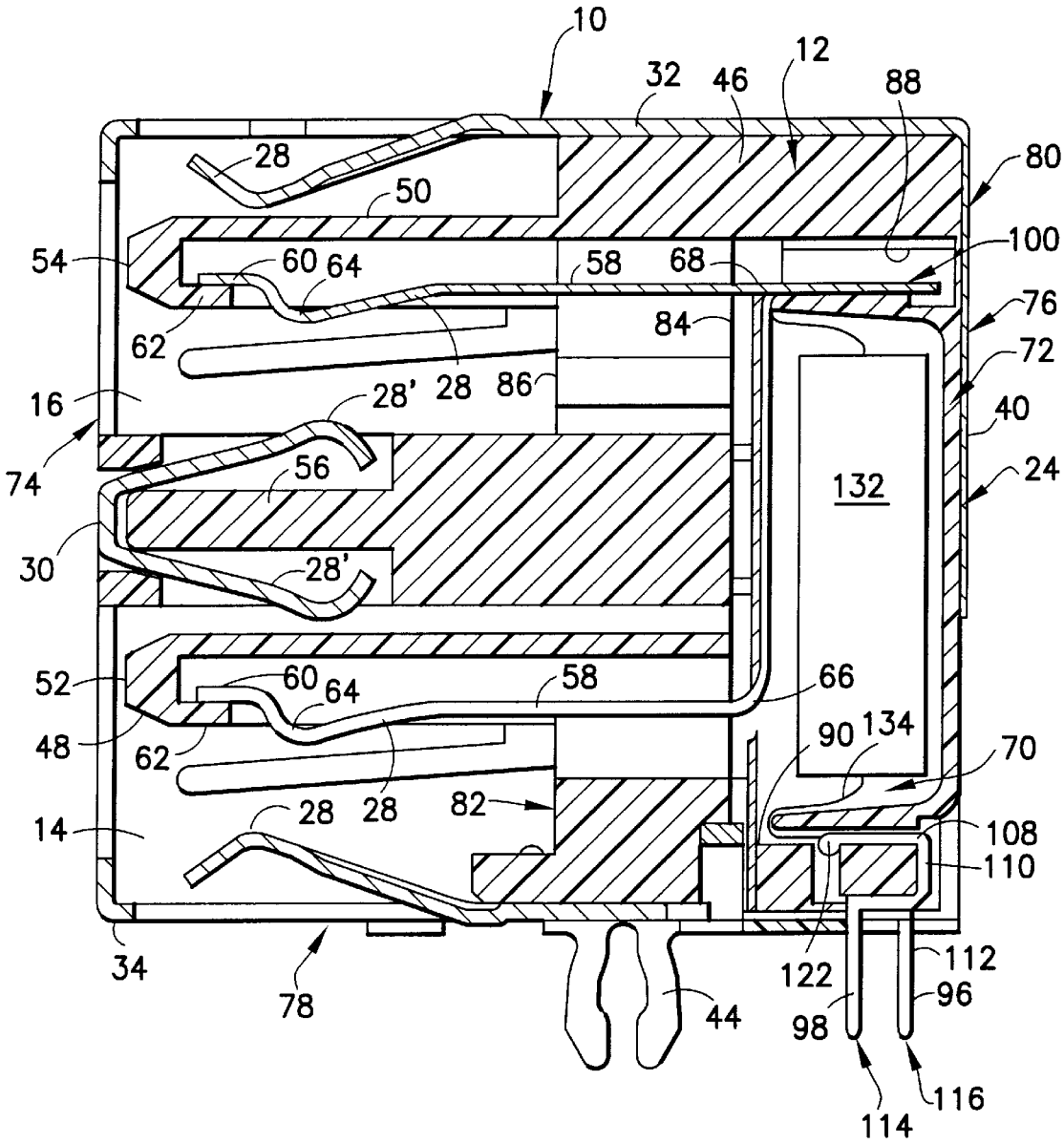
FIG. 6 is a partial cross sectional view through 6—6 in FIG. 2.

As shown in FIGS. 3, 5 and 7 the lower group 22 of contacts 18 include a first section 58 which extends into the receptacle 14 and is supported by the flange 48 and the medial wall 82. The extended section 66 of these contacts 18 first bends upwardly in the recess 70 until it generally reaches the top wall 88 and then it bends rearward along the top wall 88 of the recess 70 to form a first row 100 of contacts 18 for electrical connection as desired to the insert 24. As shown in FIGS. 3, 6 and 8 the upper group 20 of contacts 18 also include a first section 58 which extends into the receptacle 16 and is supported by the flange 50 and the medial wall 82. The extended section of these contacts 18 go generally straight into the recess 70 along the wall 88 to form part of the first row 100 of contacts 18. In the first row 100 of contacts 18 the contacts from groups 20 and 22 alternate or are staggered within the row.

As shown in FIG. 1, in a particularly preferred embodiment the second group 22 of second contacts 18' are arranged in the second receptacle 16 above the first group 20 of first contacts 18" in the first receptacle and corresponding first group 20 and second group 22 contacts 18 within the receptacles are aligned in a given plane. For example, second contact 18' in the second group 22 is arranged directly above first contact 18" in the first group 20 so that they lie in a common plane. As shown best in FIGS. 7 and 8, preferably the contacts 18 have a given width W1 in their contactor section 58 and a narrower width W2 in their extension sections 66 or 68. The extension sections 68 of the first group 20 of contacts 18 are arranged along one side 102 of contacts 18. The extension sections 66 of the second group 22 of contacts 18 are arranged along an opposing side 104 of the contacts 18. This permits the extensions 68 or 66 of the respective first and second groups 20 or 22 of contacts 18 to extend substantially parallel to one another along the wall 88 of the recess without interference or electrical shorting. The present invention, however, contemplates that other methods of arranging the extensions 66, 68 of contacts 18 into single file could be used.

As shown in FIGS. 2, 3, 5, 6, 9, 10 and 11 a third group 106 of contacts 96 and 98 is arranged separately from the first 20 and second 22 groups of contacts 18 along a different wall 90 of the recess 70 for connection to the insert 24 and for connecting the stacked connector 10 to circuitry (not shown) external of the stacked connector 10 and the insert 24. The extensions of the first and second groups 20 and 22 of contacts 18 are arranged in the top portion of the connector 10 along the wall 88 and the third group 106 of contacts 96 and 98 are arranged in a row 108 in the bottom portion of the connector 10 along wall 90. The contacts 96 and 98 preferably alternate within the row 108. A first mating portion 110 of the contacts 96 and 98 are supported in slots 120 in the bottom wall 90 and are arranged as a single second row of contacts 96 and 98 in the recess 70 along the bottom wall 90 of the recess. The contacts 96 and 98 include a second, or mounting portion 112 which are arranged in at least two substantially parallel rows 114 and 116 for electrical connection externally of the connector 10 to a printed wiring board, (not shown). Although shown as through hole-type terminations, other types of terminations (e.g. surface mount) could be used.

The first portion 110 of the contacts 96 and 98 are adapted for electrical connection to the insert 24 and the second portions 112 are adapted for connection to external circuitry. The portions 112 for external connection arranged in the first row 114 correspond to the contacts 18 in the first receptacle 14 and the terminal portions 112 in the second row 116 corresponding to the contacts 18 in the second receptacle 16. Each of the terminals 98 for external connection in the first row 114 is preferably arranged in a common plane with a corresponding terminal 96 for external connection in the second row 116. In the embodiment shown the terminals 96 for external connection in the second row 116 may include a bend portion 118 intermediate the first and second portions 110 and 112 of the contacts 96. This permits the contacts 96 in the second row 116 to transition from a single row of contacts at the first portion 110 thereof to the substantially parallel rows 114 and 116 of contacts 96 and 98 at the second portions 112 thereof.

Figure 9:
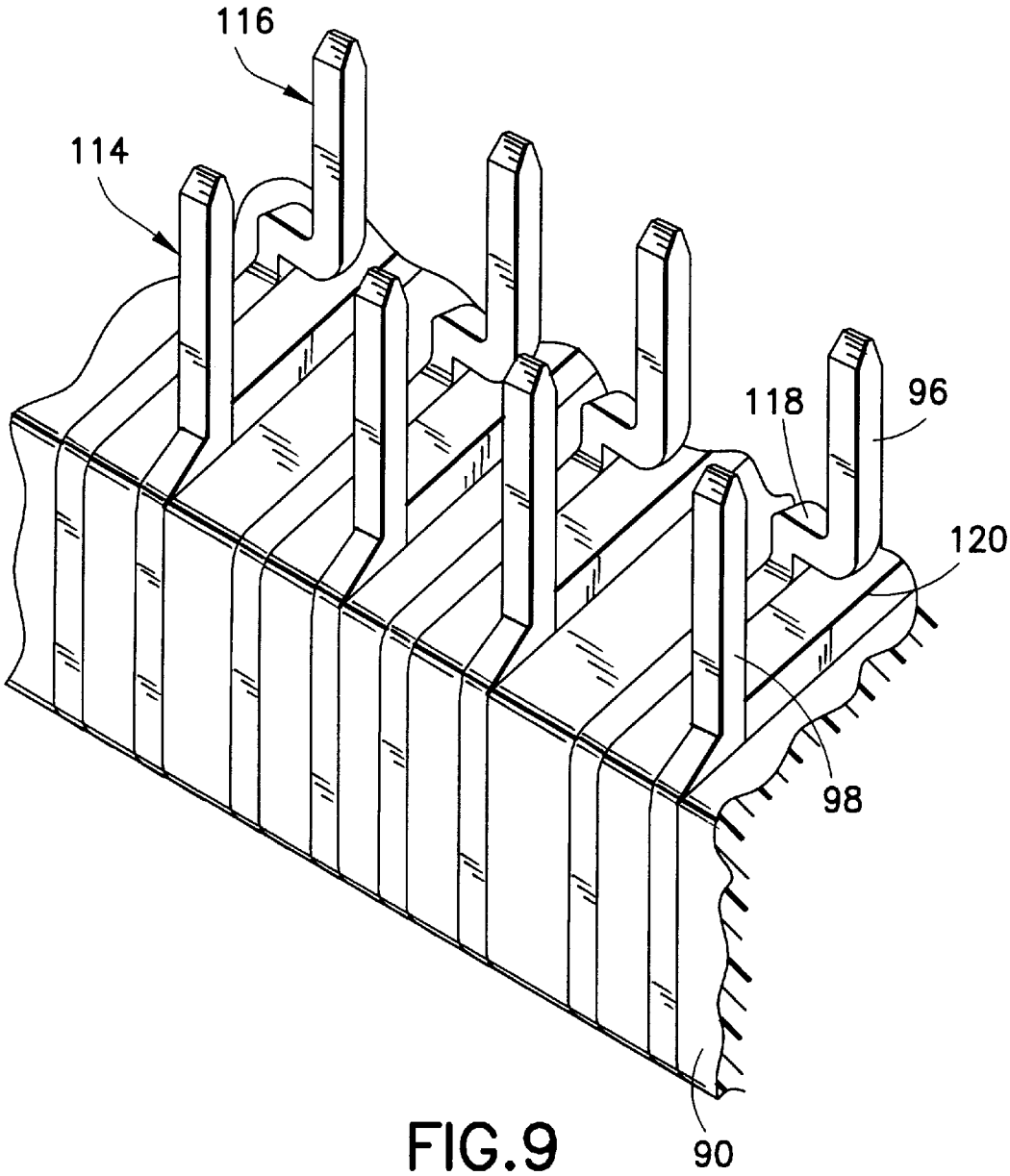
FIG. 9 is a partial perspective view of the rows of contacts for connection to circuitry external of the connector of FIG. 1 viewed from the bottom of the connector.

As shown in FIGS. 9, 10 and 11 the first portion 110 of the contacts 96 and 98 have a "C" shape for snapping into the slots 120 in the bottom wall 88 of the housing 12. They are held in place by the projection 122 at the free end of the contact portion 110 such as by friction. In contacts 96 the opposing end of the "C" shaped portion 110 at the bend 118 first bends generally perpendicularly to the "C" shaped portion in the plane of that portion. It then bends generally perpendicularly again in a plane generally normal to the plane of the "C" shaped portion 110. Finally it bends once again generally perpendicularly to the plane of the second bend and extends as the terminal portion 112 in a plane generally parallel to the plane of the "C" shaped portion 110. The bend in the terminals 96 moves those terminals in row 116 behind the terminals 98 in the row 114 so that each of the terminals 96 in row 114 are arranged in a common plane with a corresponding terminal 98 in the other row 116. The terminal portions 112 of terminals 96 extend from the inner end of the "C" shaped portion 110 opposed to the free end thereof. The terminal portions 112 of the terminals 98 extend from the leg of the "C" shaped portion 110 rearward of the terminals 96.

Figure 4:
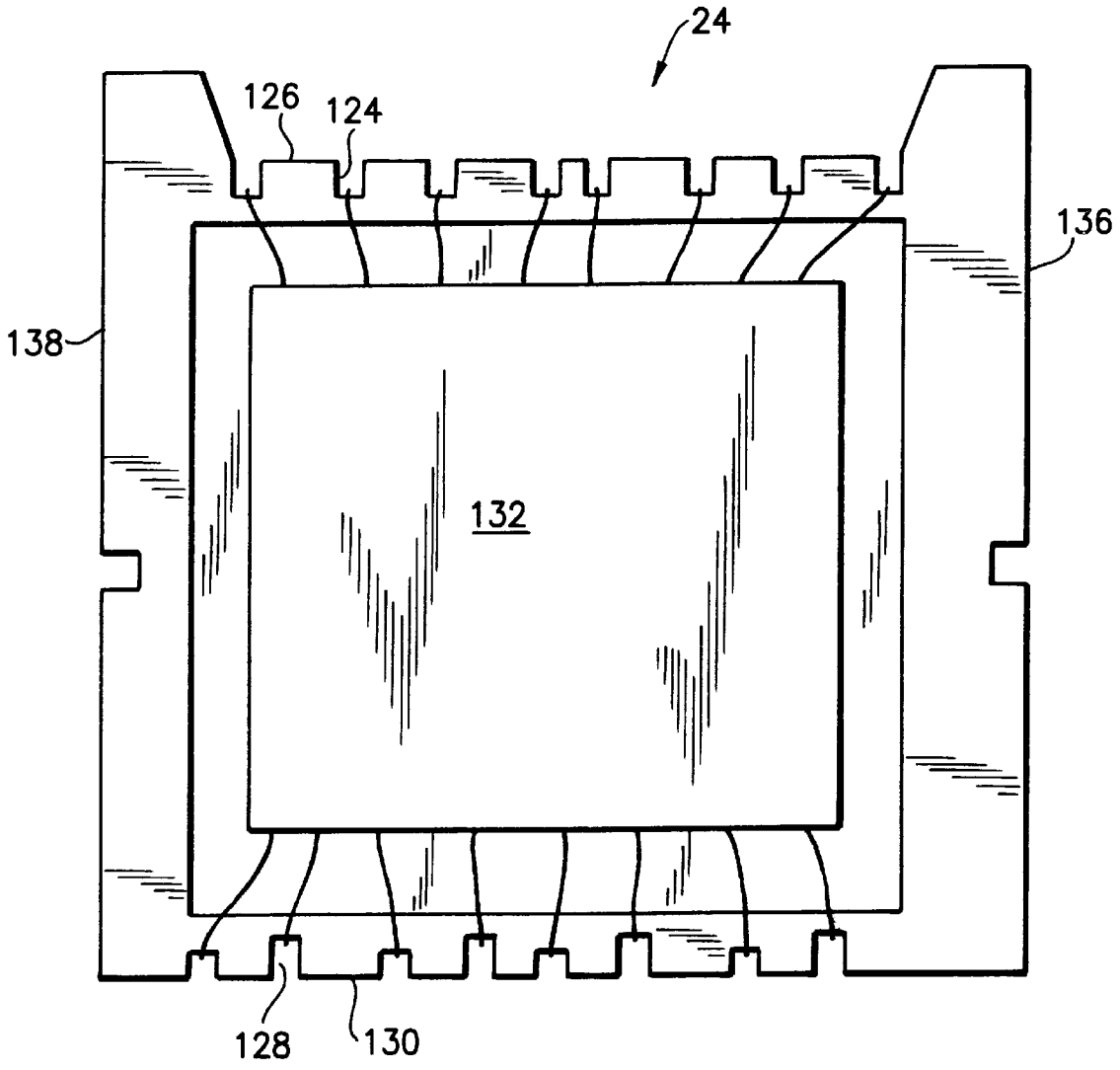
FIG. 4 is a rear view of the filter insert of FIG. 3.

In the most preferred embodiment as shown in FIGS. 2, 3 and 4 a filter insert 24 is provided in the recess 70, which is electrically connected between the extensions 66 and 68 of the first and second groups 20 and 22 of contacts 18 arranged in the row 100 at the top wall 88 of the recess and the first portions 110 of the contacts 96 and 98 in the row 108 at the bottom wall 90 of the recess 70, which are to be utilized in the circuitry connected by the connector. The insert 24 has a series of slots 124 at its top wall 126 which are adapted to receive the contact extensions 66 and 68 in the row 100 at the top wall 88 of the recess 70 and a second series of slots 128 at its bottom wall 130 which are adapted to receive the first portions 110 of the contacts/terminals 96 and 98 in the row 108 at the bottom wall 90 of the recess.

A filter circuit element or elements 132 such as common mode chokes are supported within the insert 24. Other filtering elements known to those skilled in the art such as inductive serial filters, differential filters, low pass capacitive filters and other magnetic filters may be used. Conductors such as wires shown generally as 134 extend from the filter circuit 132 into the top slots 124 and bottom slots 128 of the insert for connecting the filtering circuit elements to the contact extensions 66 and 68 and the contact portions 110 of the contact 96 and 98. The connection between the wires 134 and the respective contacts 66, 68, 96 and 98 may be made by any desired means, as for example, soldering, brazing, welding or by mechanical spring contact. The insert 24 can comprise a potted module wherein a polymer is molded about the filter circuit elements or it can comprise a hollow insert as shown wherein the filter circuit elements are supported with the insert 24. The insert 24 in addition to its top 126 and bottom 130 walls further includes opposing side walls 136 and 138 connecting the top and bottom walls. It further includes a rear wall 140. In the embodiment shown the insert has a box shape made up of these walls 126, 130, 136, 138 and 140, however if desired it could be a fully enclosed box having a front wall (not shown). The filtering circuit elements can be supported within the insert 24 by any desired means.

It should be understood, the electrical circuit 132 is preferably a filter or the like, although it will be recognized that other electrical devices may be received in the insert 24 without departing from the spirit and scope of the present invention. For example, the electrical device may be a resistor or capacitor, a simple electronic circuit, an antenna, a complex integrated circuit, etc.

In particular, it is seen in FIG. 2 that the outer shield 26 includes a rear wall 40 which when bent into place behind the insert 24 completes the connector 10 and holds the insert 24 in place. Importantly, the aforementioned ground shield 26 is fitted over the housing 12 and insert 24 so that the rear wall 40 covers the rear portion of each contact 66, 68, 96 and 98. It should be understood, the shield 26 is grounded or is to be grounded, and therefore it should not touch those contacts. The rear panel 40 of the shield 26 is preferably spaced from the rear portion of the housing 12 by a distance of about 1 mm, although greater spacing may be employed without departing from the spirit and scope of the present invention.

Figure 12:
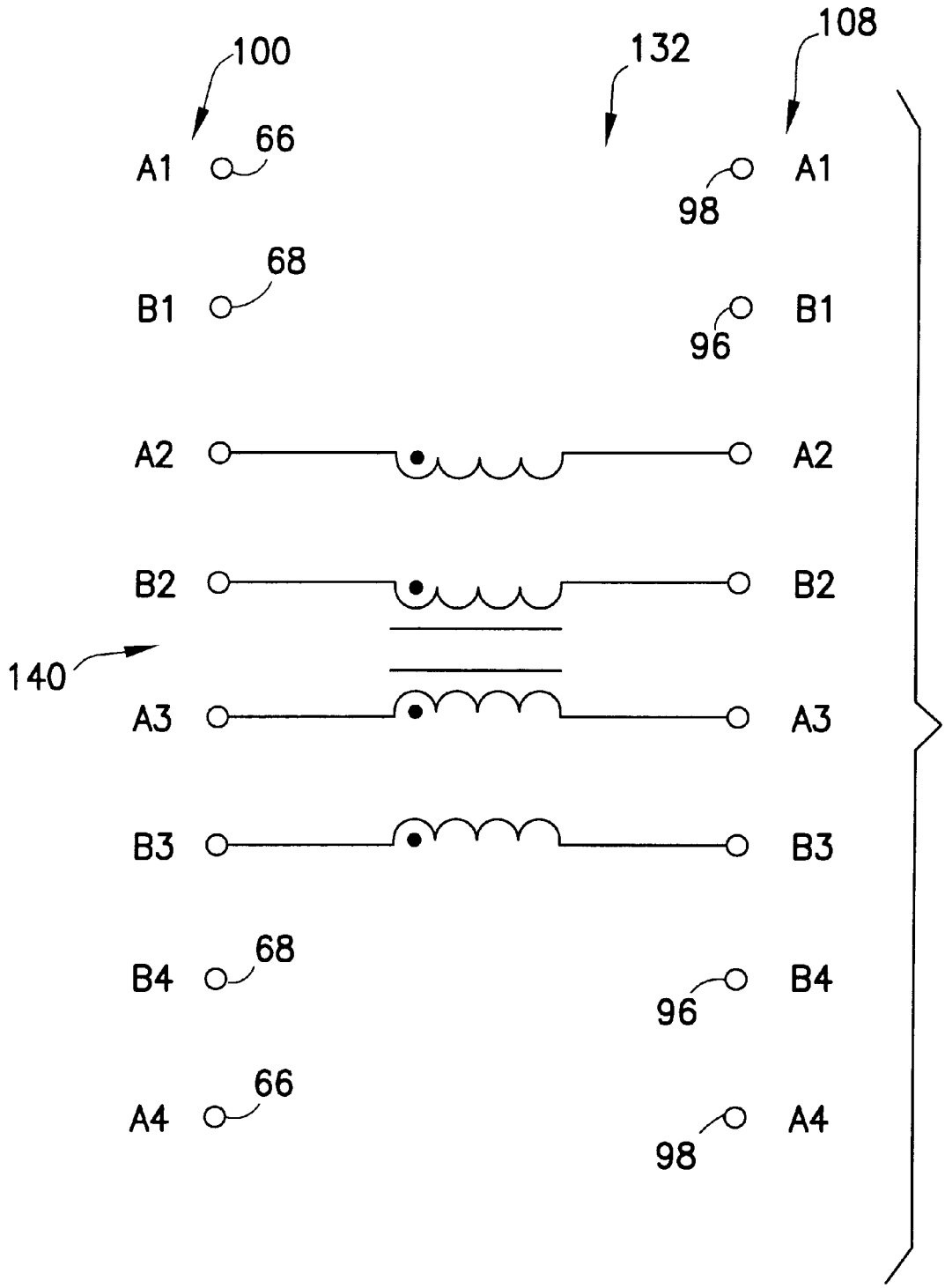
FIG. 12 is circuit diagram for an exemplary embodiment of a filtering insert for use in the stacked connector of this invention.
Figure 13:
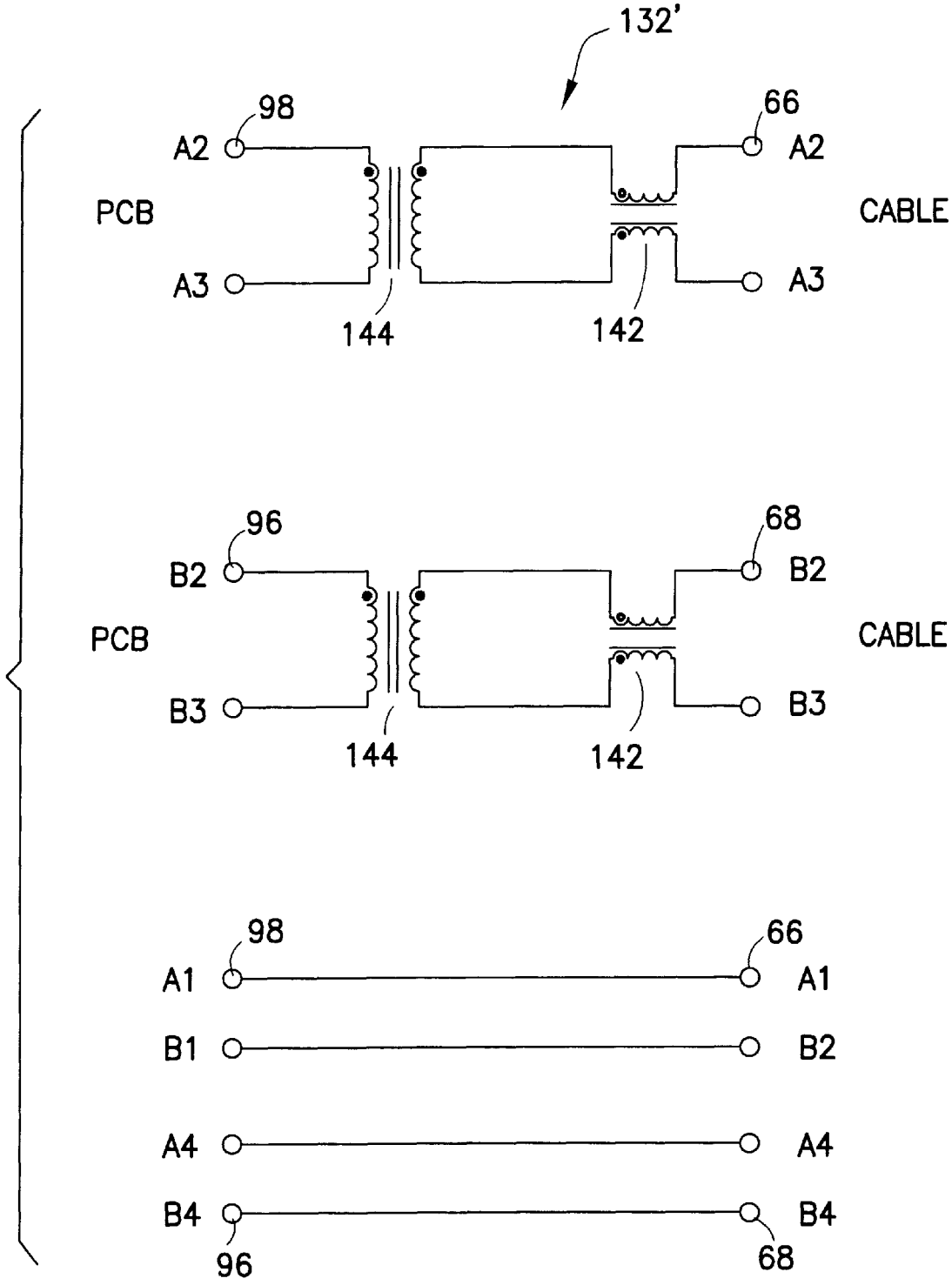
FIG. 13 is circuit diagram for a further exemplary embodiment of a filtering insert for use in the stacked connector of this invention.
Figure 14:
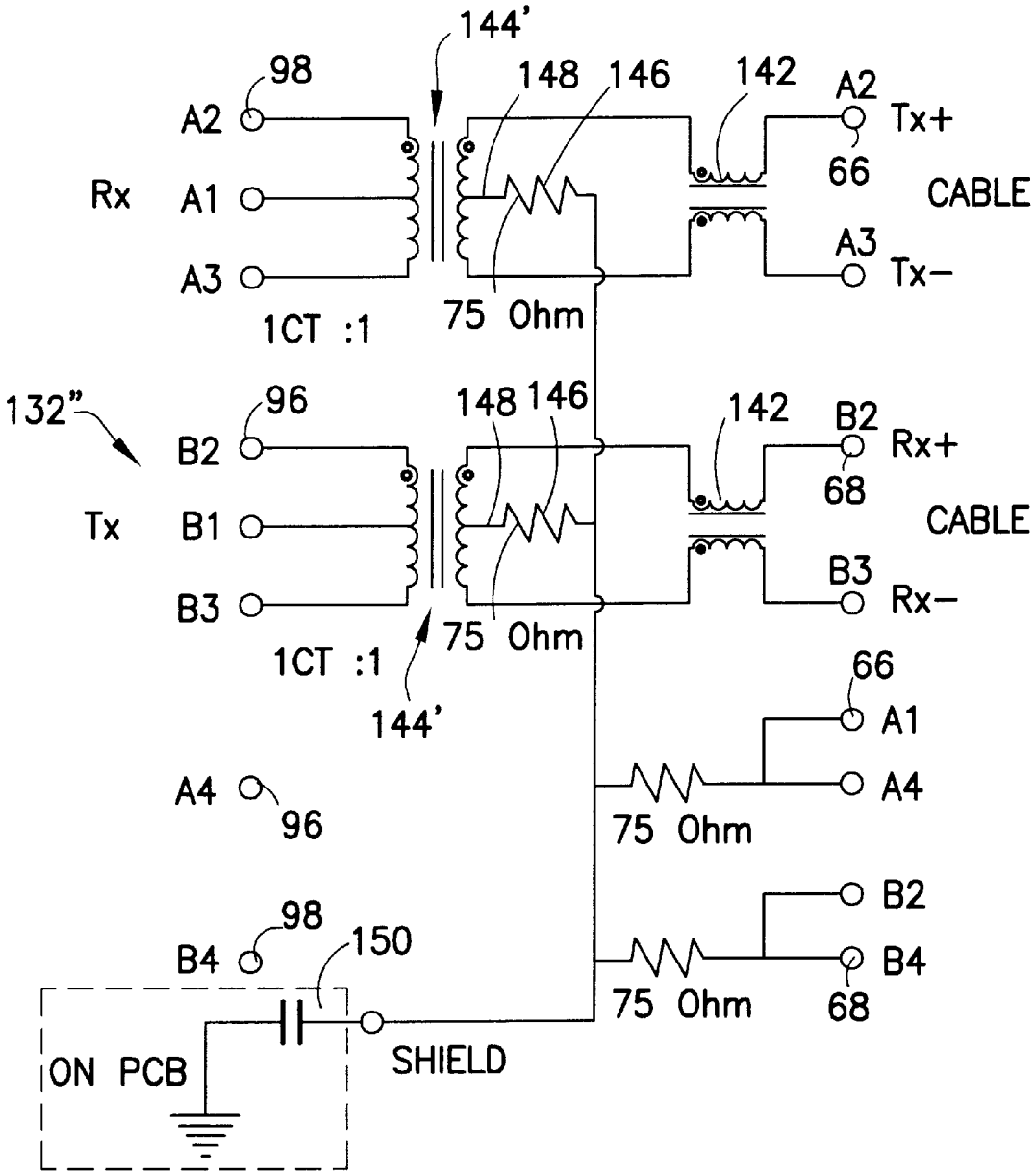
FIG. 14 is circuit diagram for a still further exemplary embodiment of a filtering insert for use in the stacked connector of this invention.

Referring now to FIGS. 12, 13 and 14 a brief description of exemplary filtering circuit diagrams that can be used within the insert 24 of a double deck universal serial bus connector will be described by way of example. There are, in general, three types of electrical diagrams represented in these FIGS.

FIG. 12 illustrates a filtering circuit 132 that contains a common mode choke 142. FIG. 13 shows a filtering circuit 132' containing common mode chokes 142 in combination with isolation transformers 144. FIG. 14 illustrates an electrical filtering circuit 132" that contains other components for signal conditioning and electromagnetic interference reduction. In each Figure "A" represents one receptacle (e.g. 14), wile "B" represents the other receptacle (e.g. 16). Therefore, "A1", "A2," "A3" and "A4" represent the group (e.g. 20) of contacts 18 in one receptacle. Likewise, "B1", "B2", "B3" and "B4" represent the group (e.g. 22) of contacts 18 in the other receptacle.

The purposes of all the filtering circuits 132, 132' and 132" shown are: to reduce EMI (electromagnetic interference) and improve product safety and signal quality. The electrical and magnetic components are used to connect upper and lower portions of an exemplary double deck USB connector 10 to a printed circuit board (PCB). The electrical components can be used to achieve the stated purpose in both single-ended and differential transmission modes. Since the differential transmission is more common the following discussion focuses on the differential transmission applications. In a differential transmission mode a useful signal is transmitted using 2 wires (pair).

In the electrical diagram of FIG. 12 the EMI is reduced by introducing the serial impedance to a time variable signal. If a differential pair in the electrical circuit 132 is selected as A2 and B2, then the wires are twisted together and threaded through a common inductor forming a common mode choke 142. In such an arrangement the signal represented as a differential between voltages on the individual wires is not affected, but a common mode or parasitic voltage is attenuated proportionally to the properties of the common mode choke (magnetic permeability, number of turns and so on). The filtering circuit 132 provides inexpensive means to reduce EMI and is easily included in the insert 24.

The filtering circuit 132' of FIG. 13 provides a transformer 144 that isolates input (cable) from output (solder tails). This transformer 144 separates the dangerous high speed pulses that may damage equipment or become a safety risk to the user (lightning or ESD electrostatic discharge). In addition the transformer 144 is a low pass filter, i.e. the voltage changes on one transformer winding induce the corresponding voltage changes on another winding. However due to inductive properties the high frequency harmonics are attenuated by the transformer. The transformer 144 is also used simply to regulate the signal voltages as needed for signal processing. In some cases the transformers 144 are used to go from a signal ended (duplex) to a differential signaling.

The filtering circuit 132" of FIG. 14 is similar to FIG. 13 with an important difference that the circuit 132" contains additional components or circuit elements. In the configuration shown resistors 146 are connected to central tabs 148 of the transformers 144', and also all cable inputs are connected to a common ground through a high voltage capacitor 150. The impedance of such a circuit 132" is close to the impedance of the input cable so the reflections that are caused by impedance mismatch are reduced. In addition to that, the input wires 4–8 not used for signal transmission are terminated (connected to the ground), so that any voltage mode on these wires is prevented from radiating. The high voltage capacitors 150 isolate sensitive equipment form the discharges that may affect equipment through common ground The filtering circuits 132, etc. presented in FIGS. 12–14 are merely illustrative and various other filtering circuit elements or other circuit designs could be employed in the insert 24. The enlarged size of the insert 24 in accordance with this invention permits a larger number of circuit elements to be included in the insert circuitry, which provides a substantial improvement over prior approaches. The values for the various elements illustrated in FIGS. 12–14 may be selected as desired in accordance with conventional practice.

While the present invention has been described in connection with the embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A stacked electrical connector comprising:

a first receptacle in a first portion of said connector;

a second receptacle stacked on the first receptacle in said first portion of said connector;

a group of first contacts arranged in said first receptacle;

a group of second contacts arranged in said second receptacle;

a second portion of said connector being arranged adjacent to said first and second receptacles and including a recess extending across said first and second receptacles for receiving an insert containing at least one filtering circuit element;

said groups of first and second contacts having extensions extending into said second portion of said connector, said extensions of said first and second contacts being arranged along one wall of said recess for connection to said insert;

a group of third contacts separate from said groups of first and second contacts, said group of third contacts being arranged along a different wall of said recess for connection to said insert and for connecting said stacked connector to circuitry external of said stacked connector and said insert; and wherein the extensions of the first and second contacts are arranged in a top portion of the connector and the third contacts are arranged in a bottom portion of the connector;

wherein the extensions of the first and second contacts are arranged in a row along said wall with the extensions of the first contacts alternating in the row with the extensions of the second contacts; and wherein the second contacts in the second receptacle are arranged above the first contacts in the first receptacle and wherein corresponding first and second contacts in said receptacles are aligned in a given plane and wherein the first and second contacts have a given width in said receptacles and a narrower width in the extensions of said contacts.

2. The stacked connector of claim 1, wherein the extensions of the first contacts are arranged toward one side of said first or second contacts and the extensions of the second contacts are arranged toward an opposing side of said first or second contacts, the extensions of the first and second contacts extending substantially parallel to one another to said one wall without interference.

3. A stacked connector comprising:

a first receptacle in a first portion of said connector;

a second receptacle stacked on the first receptacle in said first portion of said connector;

a group of first contacts arranged in said first receptacle;

a group of second contacts arranged in said second receptacle;

a second portion of said connector being arranged adjacent to said first and second receptacles and including a recess extending across said first and second receptacles for receiving an insert containing at least one filtering circuit element;

said groups of first and second contacts having extensions extending into said second portion of said connector, said extensions of said first and second contacts being arranged along one wall of said recess for connection to said insert;

a group of third contacts separate from said groups of first and second contacts, said group of third contacts being arranged along a different wall of said recess for connection to said insert and for connecting said stacked connector to circuitry external of said stacked connector and said insert;

said insert in said recess, said insert being electrically connected to the extensions of said first and second contacts which are to be utilized in operation of the connector;

wherein the extensions of the first and second contacts are arranged in a top portion of the connector and the third contacts are arranged in a bottom portion of the connector;

wherein the extensions of the first and second contacts are arranged in a row along said wall with the extensions of the first contacts alternating in the row with the extensions of the second contacts; and wherein the second contacts in the second receptacle are arranged above the first contacts in the first receptacle and wherein corresponding first and second contacts in said receptacles are aligned in a given plane and wherein the first and second contacts have a given width in said receptacles and a narrower width in the extensions of said contacts.

4. The stacked connector of claim 3, wherein the extensions of the first contacts are arranged toward one side of said first or second contacts and the extensions of the second contacts are arranged toward an opposing side of said first or second contacts, the extensions of the first and second contacts extending substantially parallel to one another to said one wall without interference.

5. A stacked electrical connector comprising:

a first receptacle in a first portion of said connector;

a second receptacle stacked on the first receptacle in said first portion of said connector;

a group of first contacts arranged in said first receptacle;

a group of second contacts arranged in said second receptacle;

a second portion of said connector being arranged adjacent to said first and second receptacles and including a recess extending across said first and second receptacles for receiving an insert containing at least one filtering circuit element;

said groups of first and second contacts having extensions extending into said second portion of said connector, all of said extensions of said first and second contacts being arranged in one row along one wall of said recess for connection to said insert; and a group of third contacts separate from said groups of first and second contacts, said group of third contacts being arranged along a different wall of said recess for connection to said insert and for connecting said stacked connector to circuitry external of said stacked connector and said insert.

6. The stacked connector of claim 5, wherein the extensions of the first and second contacts are arranged in a top portion of the connector and the third contacts are arranged in a bottom portion of the connector.

7. The stacked connector of claim 6, wherein the extensions of the first and second contacts are arranged in the row along said one wall with the extensions of the first contacts alternating in the row with the extensions of the second contacts.

8. A stacked connector comprising:

a first receptacle in a first portion of said connector;

a second receptacle stacked on the first receptacle in said first portion of said connector;

a group of first contacts arranged in said first receptacle;

a group of second contacts arranged in said second receptacle;

a second portion of said connector being arranged adjacent to said first and second receptacles and including a recess extending across said first and second receptacles for receiving an insert containing at least one filtering circuit element;

said groups of first and second contacts having extensions extending into said second portion of said connector, all of said extensions of said first and second contacts being arranged in one row along one wall of said recess for connection to said insert;

a group of third contacts separate from said groups of first and second contacts, said group of third contacts being arranged along a different wall of said recess for connection to said insert and for connecting said stacked connector to circuitry external of said stacked connector and said insert; and said insert in said recess, said insert being electrically connected to the extensions of said first and second contacts which are to be utilized in operation of the connector.

9. The stacked connector of claim 8, wherein the extensions of the first and second contacts are arranged in a top portion of the connector and the third contacts are arranged in a bottom portion of the connector.

10. The stacked connector of claim 9, wherein the extensions of the first and second contacts are arranged in the row along said wall with the extensions of the first contacts alternating in the row with the extensions of the second contacts.

11. A stacked electrical connector comprising:

a first receptacle in a first portion of said connector;

a second receptacle stacked on the first receptacle in said first portion of said connector;

a group of first contacts arranged in said first receptacle;

a group of second contacts arranged in said second receptacle;

a second portion of said connector being arranged adjacent to said first and second receptacles and including a recess extending across said first and second receptacles for receiving an insert containing at least one filtering circuit element;

said groups of first and second contacts having extensions extending into said second portion of said connector, said extensions of said first and second contacts being arranged along one wall of said recess for connection to said insert;

a group of third contacts separate from said groups of first and second contacts, said group of third contacts being arranged along a different wall of said recess for connection to said insert and for connecting said stacked connector to circuitry external of said stacked connector and said insert; and wherein a first portion of the group of third contacts is arrange in a single row in said recess along said different wall, and a second portion of the group of third contacts is arranged in at least two substantially parallel rows for connection externally of said connector, said first portion of said group of third contacts being adapted for connection to said insert and said second portion of said group of third contacts being adapted for connection to external circuitry.

12. The stacked connector of claim 11, wherein a first row of said contacts for external connection correspond to the contacts in said first receptacle and a second row of said contacts for external connection correspond to the contacts in said second receptacle.

13. The stacked connector of claim 12, wherein each of the contacts for external connection in said first row is arranged in a common plane with a corresponding contact for external connection in said second row.

14. The stacked electrical connector of claim 13, wherein the third contacts for external connection in one of said first or second rows of contacts for external connection include a bend portion intermediate the first and second portions of said third contacts, which permits the contacts in said one of said rows to transition from a single row of third contacts at said first portion thereof to the substantially parallel rows of said third contacts at said second portion thereof, with the corresponding contacts in one row of said third contacts being arranged in a common plane with the corresponding contacts in the other row of third contacts.

15. A stacked connector comprising:

a first receptacle in a first portion of said connector;

a second receptacle stacked on the first receptacle in said first portion of said connector;

a group of first contacts arranged in said first receptacle;

a group of second contacts arranged in said second receptacle;

a second portion of said connector being arranged adjacent to said first and second receptacles and including a recess extending across said first and second receptacles for receiving an insert containing at least one filtering circuit element;

said groups of first and second contacts having extensions extending into said second portion of said connector, said extensions of said first and second contacts being arranged along one wall of said recess for connection to said insert;

a group of third contacts separate from said groups of first and second contacts, said group of third contacts being arranged along a different wall of said recess for connection to said insert and for connecting said stacked connector to circuitry external of said stacked connector and said insert;

said insert in said recess, said insert being electrically connected to the extensions of said first and second contacts which are to be utilized in operation of the connector; and wherein a first portion of the group of third contacts is arranged in a single row in said recess along said different wall, and a second portion of the group of third contacts is arranged in at least two substantially parallel rows for connection externally of said connector, said first portion of said group of third contacts being adapted for connection to said insert and said second portion of said third group of contacts being adapted for connection to external circuitry.

16. The stacked connector of claim 15, wherein a first row of said contacts for external connection correspond to the contacts in said first receptacle and a second row of said contacts for external connection correspond to the contacts in said second receptacle.

17. The stacked connector of claim 16 wherein said first portion of the third group of contacts is electrically connected to the extensions of said first and second contacts which are to be utilized in operation of the connector.

18. The stacked connector of claim 16, wherein each of the contacts for external connection in said first row is arranged in a common plane with a corresponding contact for external connection in said second row.

19. The stacked connector of claim 18, wherein the third contacts for external connection in one of said first or second rows of contacts for external connection include a bend portion intermediate the first and second portions of said third contacts, which permits the contacts in said one of said rows to transition from a single row of third contacts at said first portion thereof to the substantially parallel rows of said third contacts at said second portion thereof, with the corresponding contacts in one row of said third contacts being arranged in a common plane with the corresponding contacts in the other row of third contacts.

20. An electrical connector, comprising:

a housing;

a plurality of mating contacts extending through said housing each one of said mating contacts having a mating end and a tail; and a plurality of mounting contacts extending from said housing for mounting the connector to a substrate, each one of said mounting contacts having a head and a mounting end;

wherein said mating ends of said mating contacts are arranged in a first row and a second row stacked relative to said first row to engage corresponding first and second mating connectors, all of said tails of said mating contacts are arranged in a first line, and said heads of said mounting contacts are arranged in a second line spaced for said first line to receive an electronic component therebetween.

21. The electrical connector as recited in claim 20, wherein said mounting ends of said mounting contacts are arranged in a first row and a second row spaced from said first row.

22. The electrical connector as recited in claim 20, in combination with said electronic component placed between said first line and said second line.

23. The electrical connector as recited in claim 22, wherein said electronic component is a signal conditioning component.

24. The electrical connector as recited in claim 23, wherein said signal conditioning component comprises a common mode choke, an inductive serial filter, a differential filter or a low pass capacitive filter.

25. A stacked electrical connector comprising:

a first receptacle in a first portion of said connector;

a second receptacle stacked on the first receptacle in said first portion of said connector;

a group of first contacts arranged in said first receptacle;

a group of second contacts arranged in said second receptacle;

a second portion of said connector being arranged adjacent to said first and second receptacles and including a recess extending across said first and second receptacles for receiving an insert containing at least one filtering circuit element;

said groups of first and second contacts having extensions extending into said second portion of said connector, wherein a plurality of said first contact extensions and a plurality of said second contact extenions are arranged in one row along one wall of said recess for connection to said insert; and a group of third contacts separate from said groups of first and second contacts, said group of third contacts being arranged along a different wall of said recess for connection to said insert and for connecting said stacked connector to circuitry external of said stacked connector and said insert.

26. The stacked electrical connector of claim 25 comprising an insert containing at least one filtering circuit element arranged in said recess, said insert being electrically connected to the extensions of said first and second contacts which are to be utilized in operation of the connector.

27. The stacked electrical connector of claim 25 wherein the extensions of the pluralities of first and second contacts are arranged in a top portion of the connector and the third contacts are arranged in a bottom portion of the connector.

28. The stacked electrical connector of claim 25 wherein the extensions of the pluralities of first and second contacts are arranged in the row along said wall with the extensions of the plurality of first contacts alternating in the row with the extensions of the plurality of second contacts.

29. The stacked electrical connector of claim 25 wherein the second contacts in the second receptacle are arranged above the first contacts in the first receptacle and wherein corresponding first and second contacts in said receptacles are aligned in a given plane and wherein the first and second contacts have a given width in said receptacles and a narrower width in the extensions of said contacts.

30. The stacked electrical connector of claim 25 wherein a first portion of the group of third contacts is arranged in a single row in said recess along said different wall, and a second portion of the group of third contacts is arranged in at least two substantially parallel rows for connection externally of said connector, said first portion of said group of third contacts being adapted for connection to said insert and said second portion of said third group of contacts being adapted for connection to external circuitry.

* * * * *